United States Patent [19]

Mitsui et al.

[11] Patent Number: 4,606,711

[45] Date of Patent: Aug. 19, 1986

[54] FLUID PUMP WITH ECCENTRICALLY DRIVEN C-SHAPED PUMPING MEMBER

[75] Inventors: Takao Mitsui, Aichi; Toshiharu Tatsunaka; Hideaki Sasaya, both of Okazaki; Youji Kitamura, Anjo, all of Japan

[73] Assignees: Nippon Soken, Inc., Nishio; Nippondenso Co., Ltd., Kariya, both of Japan

[21] Appl. No.: 752,016

[22] Filed: Jul. 8, 1985

Related U.S. Application Data

[60] Continuation-in-part of Ser. No. 735,728, May 20, 1985, abandoned, which is a division of Ser. No. 568,143, Jan. 4, 1984, abandoned.

[30] Foreign Application Priority Data

Jan. 10, 1983 [JP] Japan ..... 58-2514
Feb. 7, 1983 [JP] Japan ..... 58-19307

[51] Int. Cl.[4] ..... F04C 2/04; F04C 18/04
[52] U.S. Cl. ..... 418/59
[58] Field of Search ..... 418/6, 55, 59

[56] References Cited

U.S. PATENT DOCUMENTS 1,229,676 6/1917 Tice ..... 418/59
1,378,065 5/1921 Varley ..... 418/59

FOREIGN PATENT DOCUMENTS 567297 12/1958 Canada ..... 418/59
825643 12/1937 France ..... 418/59
57-8385 1/1982 Japan .

*Primary Examiner*—John J. Vrablik
*Attorney, Agent, or Firm*—Cushman, Darby & Cushman

[57] ABSTRACT

A fluid pump comprises a casing at the rear of which is secured a fixed plate having a forward open longitudinal groove with a C-shaped transversal cross-section. A movable plate is placed at the front of the fixed plate and is held in a close sliding contact with the fixed plate to seal the groove to form a pumping chamber. The movable plate carries an integral pumping member which is in the form of a split-tube extending into the pumping chamber. The movable plate is driven by an eccentric drive so that the pumping member within the pumping chamber performs as oscillatory movement along a circular trajectory with its inner wall in a sealing contact with the inner wall of the pumping chamber, and with its outer wall in a sealing contact with the outer wall of the pumping chamber, thereby performing the intake and compression strokes. The pumping member and the pumping chamber are so shaped that the tangential lines drawn at their edges become parallel with each other, thereby assuring a close sealing contact at the TDC and BDC positions of the pumping member.

4 Claims, 13 Drawing Figures

FLUID PUMP WITH ECCENTRICALLY DRIVEN C-SHAPED PUMPING MEMBER

This is a continuation-in-part of application Ser. No. 735,728, filed May 20, 1985, which was a division of application Ser. No. 568,143, filed Jan. 4, 1984, both abandoned.

BACKGROUND OF THE INVENTION (1) Field of the Invention

The present invention relates to improvements in a pump of the volumetric type for pumping compressible or non-compressible fluid.

(2) Description of the Prior Art

Japanese Unexamined Patent Publication No. 57-8385, published Jan. 16, 1982, discloses a novel volumetric pump of the so-called "oscillating ring" type which comprises a pumping member or "oscillating ring" driven by an eccentric drive along a circular oscillating trajectory within a pumping chamber. The pumping member comprises a hollow cylinder split along a longitudinal slot. The pumping chamber is defined by a cylindrical inner wall formed in a fixed plate and substantially encircled by the pumping member, a cylindrical outer wall formed in the fixed plate and substantially encircling the pumping member, a partition wall extending radially between the inner and outer walls through the slot in the pumping member, and a pair of opposite side walls in close contact with the sides of the pumping member, one of the side walls being formed on the fixed plate and the other on a movable plate carrying the pumping member and driven by the eccentric drive. The radial width of the pumping chamber is selected to be equal to the wall thickness of the pumping member plus the diameter of the circular trajectory of the eccentric drive, so that a substantial sealing contact is obtained between the inner wall of the pumping member and the inner wall of the pumping chamber, as well as between the outer wall of the pumping member and the outer wall of the pumping chamber during the oscillating movement of the pumping member.

However, this pump suffers from disadvantages in that at the top-dead-center(TDC) and bottom-dead-center(BDC) positions of the pumping member there is a considerable fluid leakage from the high pressure zone to the low pressure zone of the chamber due to the presence of gaps between the pumping member and the pumping chamber walls, as described later in more detail.

SUMMARY OF THE INVENTION

An object of the present invention is to provide a fluid pump of the class described which has an improved sealing contact at any position of the pumping member.

Another object of the invention is to provide a fluid pump of the type described which enables flexibility in the overall design.

A further object of the invention is to provide a fluid pump of the class described which has an improved pumping efficiency.

According to the invention, the pumping member is shaped in the form of a section of a split-tube having an open-ended generally C-shaped transversal cross-section which is non-circular. The pumping chamber is similarly shaped in a non-circular configuration, the width of the pumping chamber being substantially equal to the wall thickness of the pumping member plus the diameter of the circular trajectory of the eccentric drive. The pumping member and the pumping chamber are so shaped that, in their transversal cross-section, the tangential lines drawn to the walls of the pumping member and the pumping chamber at the ends thereof lie parallel with each other.

With this arrangement, the pumping member has a close sealing contact with the walls of the pumping chamber at the TDC and BDC positions of the pumping member, preventing fluid leakage from occuring at these positions.

These objects of the invention as well as other features and advantages thereof will become apparent from the following description.

DESCRIPTION OF THE PREFERRED EMBODIMENTS

Figure 1:
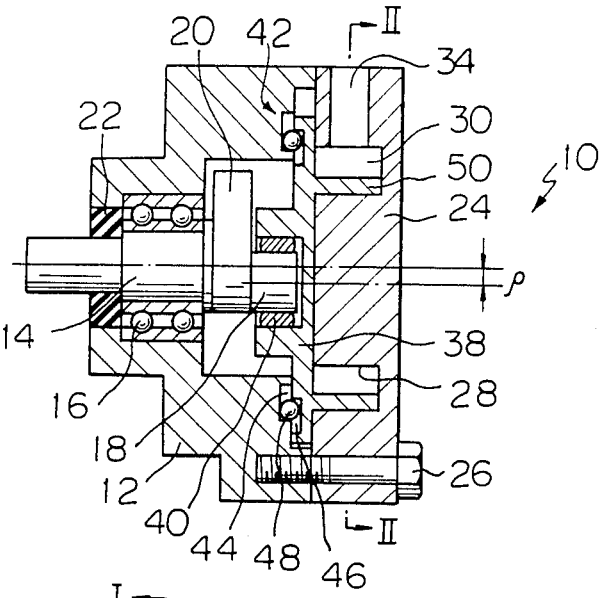
FIG. 1 is a longitudinal cross-sectional view of the pump according to the present invention taken along the line I—I in FIG. 2.
Figure 2:
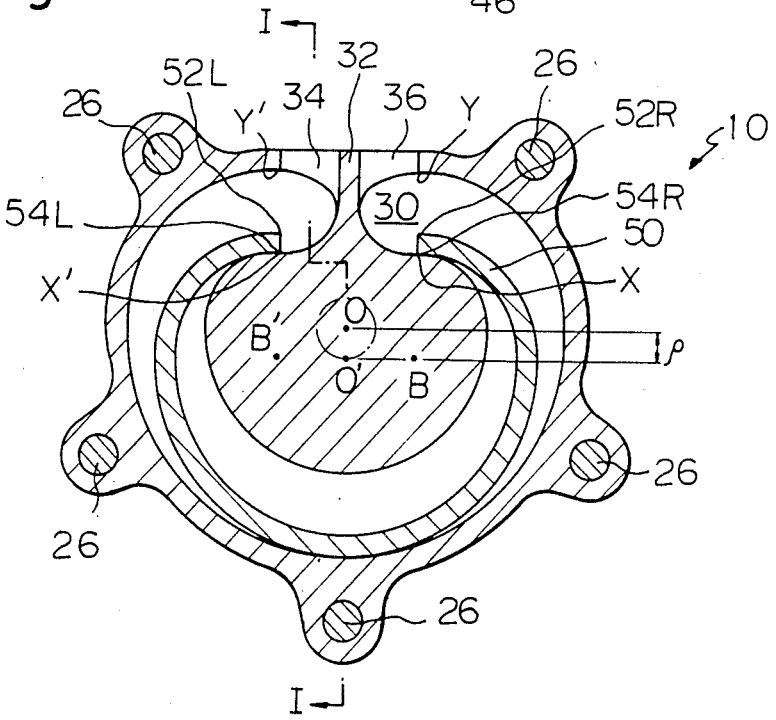
FIG. 2 is a transversal cross-sectional view taken along the line II—II in FIG. 1.

Referring now to FIGS. 1 and 2, there is shown a fluid pump 10 according to the first embodiment of the invention. The pump 10 comprises a casing 12 in which an eccentric shaft 14 is journaled by an antifriction bearing 16. The shaft 14 has an eccentric pin portion 18 which is offset by a distance from the axis of rotation O of the shaft 14. Designated as 20 is a balance weight, and as 22 a usual sealing member. The rear end of the casing 12 is closed by a fixed plate 24 fastened thereto by five bolts 26. The fixed plate 24 has a forward open groove 28 serving to form a pumping chamber 30, the configuration of the groove 28 being best shown in FIG. 2. As shown in FIG. 2, the groove 28 or pumping chamber 30 is split at the top by a partition wall 32 and has a kind of C-shaped cross-sectional configuration, the details of which will be described later. An inlet 34 and an outlet 36 open into and out of the pumping chamber 30, at respective ends thereof located adjacent to the partition wall 32.

A movable plate 38 is slidably and closely fitted between the casing 12 and the rear fixed plate 24 and is coupled with the eccentric pin 18 through an antifriction bearing 40. The movable plate 38 cooperates with the rear fixed plate 24 to seal the groove 28 to form the pumping chamber 30. Four guiding mechanisms 42 are provided to preclude the rotation of the movable plate 38 about its own axis, and to ensure that any point on the movable plate 38 performs a cyclic oscillatory movement along a circular trajectory having a radius of $\rho$. Each guilding mechanism 42 consists of a cylindrical recess 44 in the casing 12, a similar recess 46 in the movable plate 38, and a steel ball 48. The cylindrical recesses 44 and 46 have a radius equal to the distance of the eccentricity $\rho$ plus the diameter of the ball 48 and have a depth equal to one half of the diameter of the ball 48.

The movable plate 38 is provided with an integral longitudinal projection serving as a pumping member 50. The pumping member 50 is shaped in the form of a split-tube having a kind of C-shaped cross-sectional configuration, as shown in FIG. 2. As the oscillatory movement of the movable plate 38 is guided by the guiding mechanisms 42, any point on the pumping member 50 is in turn guided to move along a circular trajectory of the radius $\rho$.

The cross-sectional configuration of the pumping member 50 and the pumping chamber 30 will be described with reference to FIG. 2. The reference character O depicts the axis of rotation of the shaft 14, and the reference character O' indicates the axis of the eccentric pin portion 18. At the BDC position of the pin 18 shown in FIG. 2, the inner wall of the pumping member 50 includes a semicircle having a center at O' and continuously joined to two adjacent quadrants having respective centers at B and B', the radius of the semicircle being larger than the radius of the quadrants. The radii of the semicircle and quadrants may be selected at any value but it is important that the tangential lines drawn to them at their juncture should exactly coincide. Further, the centers O', B, and B' must be located at the same side of the tangential line so that the curvature of inner wall of the pumping member 50 is directed in the same direction. The outer wall of the pumping member 50 is defined in the similar manner but spaced from the inner wall by a uniform wall thickness. Thus, at the outer edges 52R and 52L of the pumping member 50, the tangential lines coincide with each other. Similarly, the tangential lines drawn to the inner edges 54R and 54L are in common. Further, these tangential lines at the inner and outer edges are perpendicular to the plane of the partition wall 32.

The cross-sectional contour of the pumping chamber 30 is determined as follows. The inner wall section of the pumping chamber 30 extending from the point X to the point X' in the clockwise direction consists of a curve obtained by shifting the inner wall of the pumping member 50 when centered at O toward the inside by a distance $\rho$ along the line normal to the inner wall of the pumping member 50. Similarly, the outer wall section of the pumping chamber 30 extending from the point Y to the point Y' consists of a curve obtained by displacing the outer wall of the pumping member 50 when centered at O toward the outside by the same distance $\rho$ along the line normal to the outer wall of the pumping member 50. The remaining sections of the pumping chamber 30 located adjacent to the inlet 34 and the outlet 36 may be shaped so as not to come in contact or interfere with the movement of the pumping member 50. It should be noted that the tangential lines drawn to the outer wall of the pumping chamber 30 at the edges Y and Y' do and must coincide with each other, and that the tangential lines drawn to the inner wall at the edges X and X' also do and must coincide with each other.

Operation of the pump according to the present invention will be described with reference to FIGS. 3A through 3D. As the eccentric shaft 14 is rotated in the counterclockwise direction, the eccentric pin portion 18 revolves about the axis O along a circular trajectory of the axis O' (FIG. 2), so that the movable plate 38 guided by the guiding mechanisms 42 oscillates along a circular trajectory together with the pumping member 50. In the TDC position of the eccentric pin 18 and, hence, of the pumping member 50 shown in FIG. 3A, there are two sealing contacts between the edges of the outer wall of the pumping chamber 30 and the edges of the outer wall of the pumping member 50, because the lines tangential to these edges coincide. Also, there is a sealing contact between the inner wall of the pumping chamber 30 and the inner wall of the pumping member 50. Thus, the pumping chamber 30 is divided by the pumping member 50 into three zones, of which the two are located inside the pumping member 50.

Figure 3A:
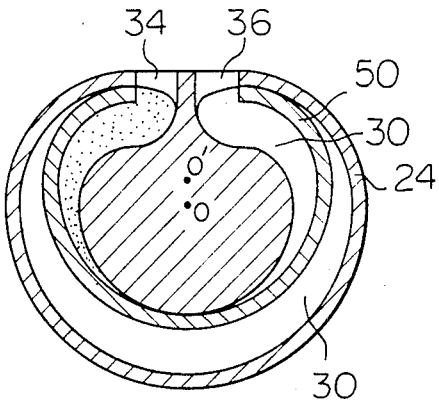
FIGS. 3A through 3D are schematic illustrations of various working stages of the pumping member in the pump shown in FIGS. 1 and 2.
Figure 3B:
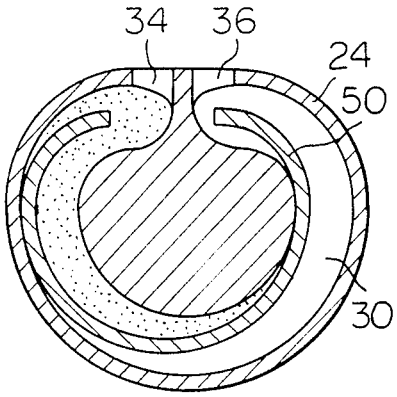

As the drive shaft 14 rotates counterclockwise through an angle of 90°, the outer sealing contact slides counterclockwise along the outer wall of the pumping chamber 30 and along the outer wall of the pumping member 50, and the inner sealing contact slides counterclockwise along the inner wall of the pumping chamber 30 and along the inner wall of the pumping member 50 until the pumping member 50 arrives at the position shown in FIG. 3B, so that the volume of the inner left zone of the pumping chamber 30 shown by the dotted area is increased to draw the fluid therein from the inlet 34.

Figure 3C:
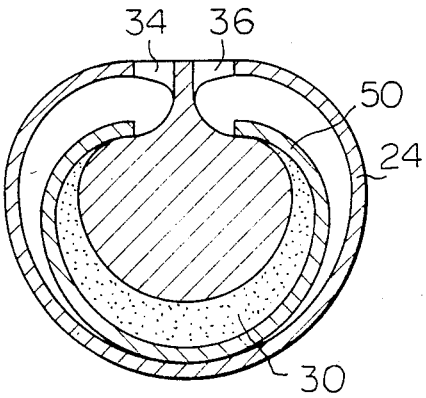

As the shaft 14 turns further through an additional angle of 90°, the pumping member 50 is brought into the BDC position shown in FIG. 3C. This moment corresponds to the termination of the intake stroke for the inner zone of the pumping chamber 30. It should be noted that in this position the inner wall of the pumping member 50 has two sealing contacts at its edges against the inner wall of the pumping chamber 30.

Figure 3D:
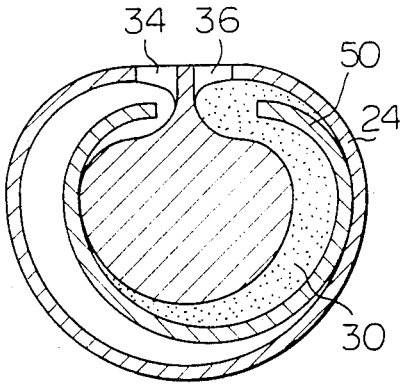

FIG. 3D shows the position of the pumping member 50 after the shaft 14 is rotated further through an angle of 90°. During this rotation, the volume of the inner zone of the pumping chamber 30 is reduced and the fluid is pressurized and discharged through the outlet 36. The compression stroke for the inner zone of the pumping chamber 30 continues until the pumping member 30 resumes the position shown in FIG. 3A.

The principle of operation is the same for the outer zone of the pumping chamber 30. For the outer zone, the intake stroke begins at the BDC position shown in FIG. 3C and continues until the TDC position shown in FIG. 3A. Compression stroke begins at the TDC position in FIG. 3A and terminates at the BDC position in FIG. 3C.

Figure 4:
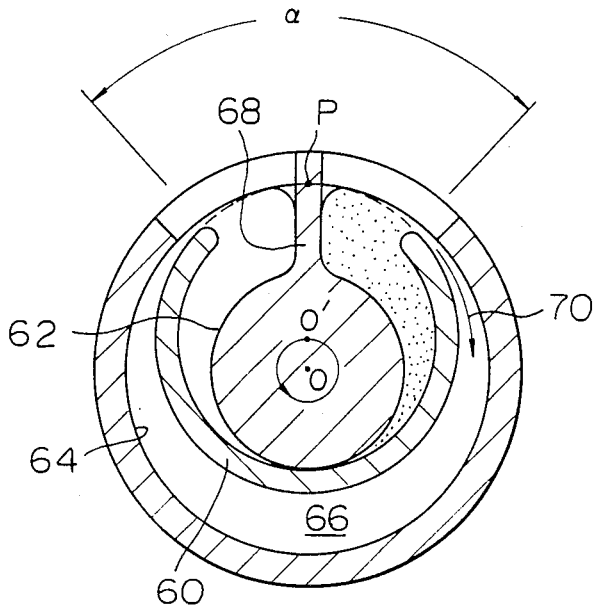
Fig. 4 PRIOR ART
FIG. 4 is a comparative view illustrating the operation of the prior art fluid pump.

The advantages of the pump according to the present invention will be described in comparison with the prior art pump construction as disclosed in the above-mentioned Japanese Unexamined Patent Publication and represented here in FIG. 4. In the prior art arrangement, the pumping member 60 consists of a hollow cylinder having a transversal cross-section of a true circle. The inner and outer walls 62 and 64 of the pumping chamber 66 also consist of a cylindrical surfaces having a center at O. The pumping member 60 has a longitudinal slot cut out through an angle $\alpha$ so that the pumping member 60 does not interfere with a partition wall 68 during the revolution of the pumping member 60 with its axis O' rotating about the axis O. With this arrangement, at the TDC position of the pumping member 60, shown in FIG. 4 there is a substantial gap between the outer wall of the pumping member 60 and the outer wall 64 of the pumping chamber 66 so that there is produced a blow-by flow of the compressed gas, as shown by the arrow 70, at the end of the compression stroke. In order to prevent this blow-by or leakage, a sealing contact must be provided at the TDC position.

However, as both the pumping member 60 and the pumping chamber 66 are cylindrical, such sealing contact is theoretically located at the imaginary point P. Since the point P is located within the partition wall 68, and because it is located within the longitudinal slot formed in the pumping member 60, it is practically impossible to obtain a sealing contact at the TDC position. The leakage or blow-by still occurs while one of the edges of the pumping member 60 is located within the angular position included in the angle $\alpha$. Also, the compressed gas will blow by when the pumping member 60 is at or near its BDC position.

It contrast, in the pump structure according to the present invention, the tangential lines drawn to the inner or outer wall of the pumping member and the pumping chamber are enveloped through an angle of 360° because the tangential lines drawn at the edges thereof coincide with each other. Thus, a snug sealing contact is obtained between the pumping member and the pumping chamber walls at the TDC and BDC positions, thereby avoiding the release of the high pressure fluid from the high pressure zone to the low pressure zone of the pumping chamber.

Figure 5A:
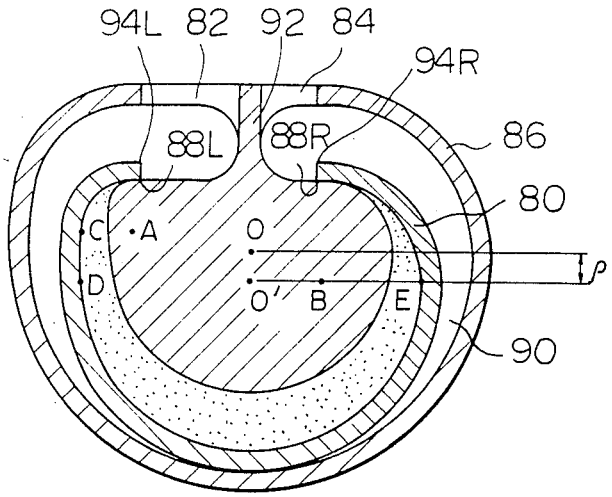
FIGS. 5A and 5B are transversal cross-sectional views of a second embodiment of the present invention.
Figure 5B:
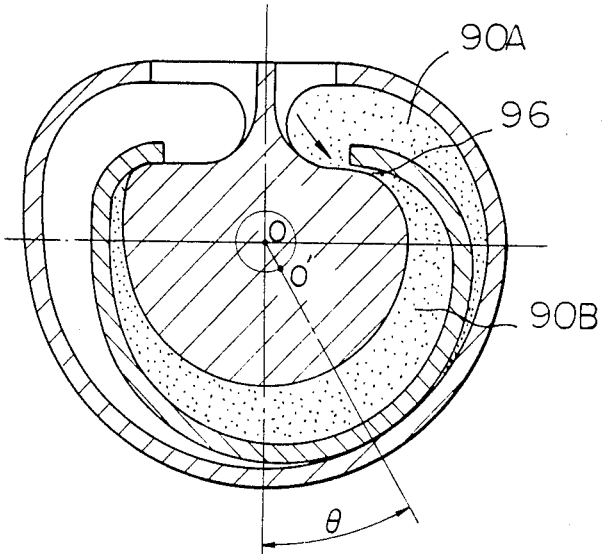

FIGS. 5A and 5B depict a second embodiment of the invention. In this embodiment, the pumping member 80 and the pumping chamber 90 are shaped asymmetrically with respect to the plane passing through the axis of rotation O of the eccentric shaft and the partition wall. Further, the right-hand halves of the pumping member 80 and the pumping chamber 90 have a larger radius of curvature than the left-hand halves.

The cross-sectional contour of the inner wall of the pumping member 80 when brought into its BDC position includes, in the counterclockwise direction from the inlet 82 toward the outlet 84 of the fixed plate 86, a quadrant with a radius $R_1$ extending from the inner left edge 88L to the position C and having a center at A, a generally straight segment CD, a semicircle DE having a radius $R_2$ with its center at O' which represents the axis of the eccentric pin portion at the BDC position, and a quadrant with a radius $R_3$ extending from the position E to the inner right edge 88R, with the relationship between the radii being $R_1<R_3<R_2$. The cross-sectional contour of the outer wall of the pumping member 80 is obtained by shifting the inner wall contour outwardly along the normal line by a uniform wall thickness.

The cross-sectional contour of the inner and outer walls of the pumping chamber 90 is determined, as in the first embodiment, by displacing the inner and outer wall configurations of the pumping member 80, when centered at O, along the normal line by a distance of eccentricity $\rho$ inward and outward, respectively. The cross-sectional contour of the end portions of the pumping chamber 90 which are located on both sides of the partition wall 92 and into which the inlet 82 and the outlet 84 open, may be defined so as not to interfere with the movement of the pumping member 80. It should be noted that the inner edges 88L and 88R of the pumping member 80 have a common tangential line, and that the outer edges 94L and 94R also have a common tangential line. Similarly, the tangential lines drawn to the inner wall of the pumping chamber 90 at the points of contact by the inner edges 88L and 88R of the pumping member 80, when the latter is in its BDC position, must coincide with each other. Also, the points on the outer wall of the pumping chamber 90 in contact with the outer edges 94L and 94R of the pumping member 80 when the latter is in its TDC position have a common tangential line.

This embodiment provides several advantages. As the profile of the pumping member 80 and the pumping chamber 90 is asymmetric with respect to the plane of the partition wall 92 passing through the axis O, and because the left-hand half of the profile has a portion having a smaller radius of curvature, it is possible to increase the cross-sectional area of the inlet 82 when compared with the outlet 84, thereby reducing the hydrodynamic loss occuring during the intake stroke.

The provision of a larger radius of curvature at the outlet side of the pumping member 60 contributes to enhance the sealability at the end of the compression stroke. To explain this in more detail, with reference to FIG. 5B, there is shown in an exaggerated manner the position of the pumping member 80 which is rotated through an infinitesimal angle of $\theta$ from the BDC position. In this moment, the outer zone 90A of the compression chamber having just been subjected to the compression stroke is still under a higher pressure, while the inner zone 90B which is about to undergo the compression stroke is yet at a low pressure. Thus, the fluid under pressure in the high pressure zone 90A tends to flowback into the low pressure zone 90B through a small gap 96 produced necessarily due to the rotation of the pumping member 80 through an angle $\theta$. This back flow, which may be termed "blow-by" flow, is inherent in the pump of this nature. According to this embodiment, the radius of curvature $R_3$ at the outlet portion of the pumping member is larger than the radius $R_1$ at the inlet portion, so that the circumferential length of the gaps 96 formed between the pumping member and the pumping chamber inner wall is extended. As a result, the flow resistance through these extended gaps 96 is considerably increased, the narrow gap serving like a close seal line acting against the back flow or blow-by flow to defer the fluid flowing from the high pressure zone into the low pressure zone. Thus, the loss of the pumping work is minimized resulting in the maximum pump efficiency.

Another advantage of this embodiment resides in the reduction and suppression in the pressure pulsation of the output. In the arrangement of this embodiment, the volume of the left-hand half of the pumping chamber differs from that of the right-hand half. Thus, assuming the BDC position to be the reference position of the pumping member, it is possible to obtain a greater delivery rate during from the −180° to 0° phase and a smaller delivery rate during from the 0° to +180° phase. By accommodating the delivery rate variation with the flow rate characteristics of consumer devices such as an air-driven motor, oil motor, or hydraulic engine served by the fluid pump, it is possible to reduce the pressure pulsation, vibration, and noise of the hydraulic or pneumatic circuit.

Figure 6:
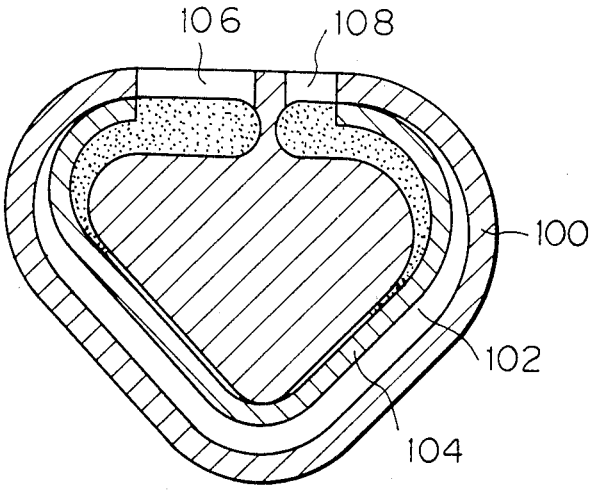
FIGS. 6 through 9 show a third through a sixth embodiments of the present invention, respectively.

FIG. 6 illustrates a third embodiment of the invention having an overall design particularly adapted to be mounted in a mounting space having a triangular cross-section. The pump rear plate 100, the pumping chamber 102 formed therein, and the pumping member 104 each has a profile of a rounded triangle consisting of segments of a straight line and arcs of a circle. The pumping member 104 and the inner and the outer walls of the pumping chamber 102 are shaped asymmetrically, similar to the structure shown in FIGS. 5A and 5B, such that the fluid inlet 106 has a larger cross-sectional area than the fluid outlet 108.

Assuming that a pump is to be mounted within a triangular mounting space so that the triangle is inscribed by the pump, and assuming that the cross-section of the mounting space is a right-angled equilateral triangle having a longer side of 170 mm, the radial wall thickness of the pump rear fixed plate is 5 mm, the wall thickness of the pumping member is 4 mm, and the distance of the eccentricity of the drive shaft is 3 mm, the cross-sectional area S of the pumping chamber of the pump shown in FIG. 2 is given as follows:

$$S=\pi(30^2-27^2+23^2-20^2)=942\ \text{mm}^2$$

The cross-sectional area S′ of the pumping chamber of the pump shown in FIG. 6 is:

$$S' = \pi \cdot \frac{225}{360}(20^2 - 17^2 + 13^2 - 10^2) + \pi \cdot \frac{135}{360}(25^2 - 22^2 + 18^2 - 15^2) + 6(38 + 35 + 23) = 1{,}212\ \text{mm}^2.$$

It follow, therefore, that S′/S=1.287. Thus, the embodiment shown in FIG. 6 has a 28.7% greater pumping chamber volume when compared with the embodiment shown in FIG. 2.

Figure 7:
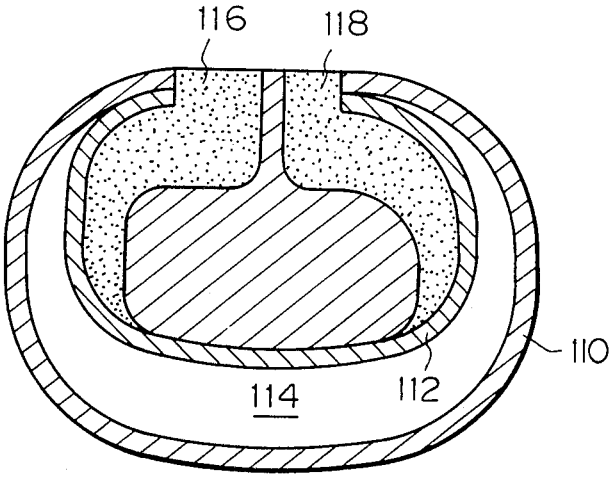

FIG. 7 shows a fourth embodiment of the invention adapted to be mounted in a rectangular mounting space. Each of the pump components 110, 112 and 114 has a rounded rectangular profile consisting of segments of a straight line and arcs of a circle. In this embodiment also, the pumping member 112 and the inner and the outer walls of the pumping chamber 114 are so designed that the cross-sectional area of the inlet 116 becomes larger than that of the outlet 118.

Figure 8:
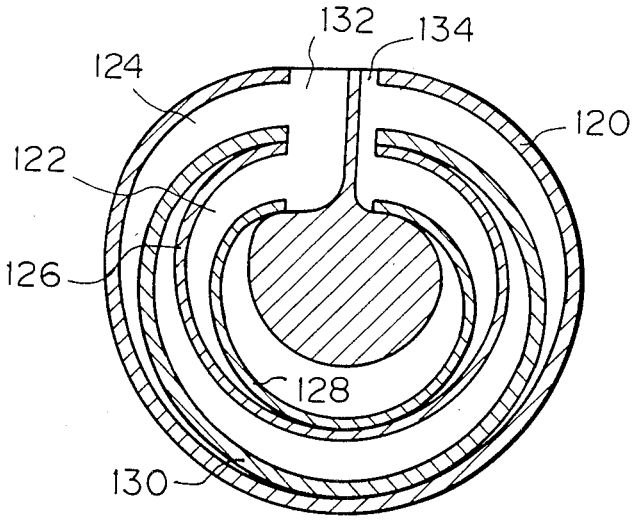

FIG. 8 illustrates a fifth embodiment of the invention having two sets of pump assemblies. The pump rear fixed plate 120 has two discrete generally C-shaped asymmetric grooves 122 and 124 serving, respectively, to form first and second pumping chambers spaced apart by a circumferential wall 126 integral with the fixed plate 120. The movable plate, not shown, carries integral therewith a first and a second pumping member 128 and 130 each in the form of a split-tube having a generally C-shaped asymmetric profile, as in the second embodiment. A common inlet 132 opens into an end of the first and second pumping chambers 122 and 124 and a common outlet 134 opens from the other end of the pumping chambers 122 and 124. It will be noted that, due to the asymmetric arrangement, the inlet 132 has a larger cross-sectional area than the outlet 134. The dimensions of the pump components may be determined according to the information described with reference to the first embodiment. This embodiment enables an increase in the total volume of the pumping chamber without increasing the distance of eccentricity and the overall size of the pump.

Figure 9:
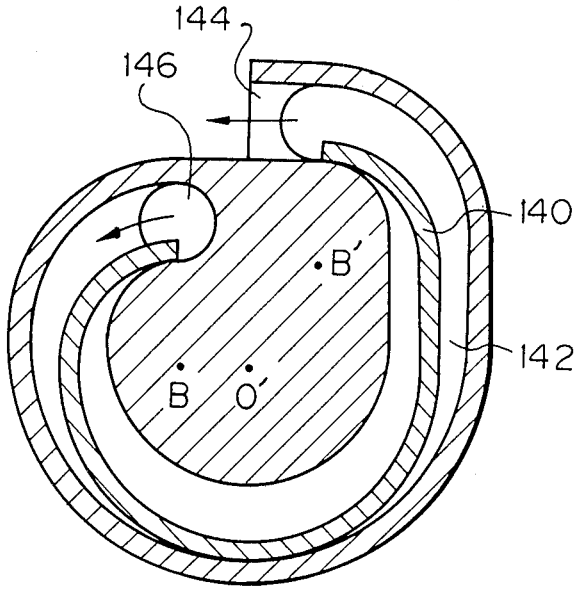

FIG. 9 shows a sixth embodiment of the invention wherein the pumping member 140 and the pumping chamber 142 are so shaped that at the side of the outlet 144 they terminate in a staggered manner at a different level, with their tangential lines at respective ends extending parallel with each other. The profile of the pumping member 140 consists of a quadrant having its center at B, a semicircle having its center at O′ representing the axis of the eccentric pin portion at its BDC position, a straight portion, and a quadrant having its center at B′. The inlet 146 opens into the pumping chamber 142 along the longitudinal direction while the outlet extends in a direction which is a smooth continuation of the direction of the pumping chamber at the side of the outlet 144. With this arrangement, the pressurized fluid flows out of the pumping chamber without undergoing substantial alteration in the flow direction, so that the bending loss of the pump output is reduced.

The present invention may be applied to liquid pumps such as oil pumps as well as to pumps for compressible fluid such as air compressors, refrigerant compressors, and superchargers for internal combustion engines.

While the present invention has been described herein with reference to the specific embodiments thereof, it should be understood that the invention is not limited thereby, and various modifications and changes may be made therein for those skilled in the art within the scope of the appended claims.

We claim:

1. An improved fluid pump of the type in which a pumping member in the form of a section of a split-tube having an open-ended, generally C-shaped transversal cross-section throughout the entire length thereof is received within an enclosed pumping chamber and is driven by an eccentric drive so that any point on said pumping member cyclically oscillates along a circular trajectory to draw the fluid into said pumping chamber through an inlet located at one end thereof and to discharge the pressurized fluid through an outlet located at the other end thereof, said pumping chamber having a length substantially equal to that of said pumping member and having a cross-sectional contour following the profile of said pumping member with the width of said pumping member, as measured along the line normal to the general line thereof, being substantially equal to the wall thickness of said pumping member plus the diameter of said circular trajectory, the improvement wherein:

said pumping member and said pumping chamber are so shaped that, in their transversal cross-section, the tangential lines drawn to the walls of said pumping member and said pumping chamber at the ends thereof are parallel with each other, whereby at the top-dead-center and the bottom-dead-center positions of said pumping member with respect to said pumping chamber, the pumping member has a close sealing contact with the walls of said pumping chamber to thereby prevent fluid leakage therethrough, and wherein, in their transversal cross-section, said pumping member and said pumping chamber are asymmetric with respect to a central plane passing through the axis of rotation of said eccentric drive so that the halves of said pumping member and said pumping chamber located at the side of said outlet have portions having larger radius of curvature than that of the other halves located at the side of said inlet and wherein said inlet has a larger cross-sectional area than that of said outlet.

2. A fluid pump as defined in claim 1, wherein the transversal cross-sectional contour of said pumping member and said pumping chamber is substantially triangular with smoothly rounded corners.

3. A fluid pump as defined in claim 1, wherein the transversal cross-sectional contour of said pumping member and said pumping chamber is substantially rectangular with smoothly rounded corners.

4. A fluid pump as defined in claim 1, further comprising a second fluid pump surrounding said first-mentioned fluid pump, said second fluid pump comprising a second pumping chamber concentric with and surrounding said pumping chamber of said first pump, a second pumping member concentric with said pumping member of said first pump and received within said second pumping chamber, said second pumping member being driven in common by said eccentric drive, and a second inlet and a second outlet communicating, respectively, with said inlet and outlet of said first pump.

* * * * *